US006826779B1

(12) United States Patent
McKenzie

(10) Patent No.: US 6,826,779 B1
(45) Date of Patent: Dec. 7, 2004

(54) ARM PROTECTION DEVICE

(76) Inventor: Mark Christopher McKenzie, 167 Woodburn Cres., Okotoks (CA), T1S 1L4

( * ) Notice: Subject to any disclaimer, the term of this patent is extended or adjusted under 35 U.S.C. 154(b) by 0 days.

(21) Appl. No.: 10/646,886

(22) Filed: Aug. 25, 2003

(51) Int. Cl.[7] ..... A41D 13/00
(52) U.S. Cl. ..... 2/16; 2/59
(58) Field of Search ..... 2/16, 20, 59, 81, 2/158, 159, 161.1, 161.3, 161.8, 163, 164, 167, 458, 907, 161.6, 69, 79, 86, 227, 88, 50, 51, 94, 89, 48, 85, 108, 93, 207, 242, 46, 914, 114, 69.5, 468, 98, 208

(56) References Cited

U.S. PATENT DOCUMENTS 2,459,992 A 1/1949 Cimino
3,389,407 A * 6/1968 Morrison ..... 2/84
4,426,740 A * 1/1984 Reverberi ..... 2/84
4,718,122 A * 1/1988 Steverson ..... 2/70
5,628,062 A 5/1997 Tseng
5,642,525 A 7/1997 Ketola
6,240,565 B1 * 6/2001 Spear ..... 2/158
6,360,370 B1 * 3/2002 Ferreras ..... 2/84
6,464,669 B2 10/2002 Wilke

* cited by examiner

*Primary Examiner*—Tejash Patel
(74) *Attorney, Agent, or Firm*—Bereskin & Parr

(57) ABSTRACT

A device for protecting the arm of a user consists of a protective sleeve and a tubular pouch sized to fit around a user's upper arm. The protective sleeve is made of a preselected protective fabric and is extendible from a retracted position to an extended position for deployment. The protective sleeve is shaped and sized such that in the extended position, the protective sleeve envelops the user's lower arm. An adjustable hand opening at the lower end of the protective sleeve is sized to allow a user's hand to extend out of the protective sleeve. The upper end of the protective sleeve is affixed to an inner portion of the pouch. The tubular pouch is shaped to form a circumferentially extending storage cavity for storing the protective sleeve in a retracted position. This cavity is closed by a closure mechanism when the protective sleeve is stored inside the pouch. The pouch has an attachment mechanism for attaching the pouch to the upper arm portion of the user's shirt. The subject arm protection device provides advantages of compact storage, ready availability, and rapid deployment for protecting the user's arm against hazards.

16 Claims, 5 Drawing Sheets

ARM PROTECTION DEVICE

FIELD OF THE INVENTION

The present invention relates to devices which protect parts of the body from harm, and in particular, to devices for protecting an arm from fire, punctures, and infectious agents.

BACKGROUND OF THE INVENTION

Persons involved in fire fighting, law enforcement, and emergency medical services require protection from a variety of hazards. These hazards include infectious agents, fire, chemicals, and stab or puncture wounds. However, current uniforms and attire generally provide little or no protection to the arms, particularly when they comprise a short-sleeved shirt.

Prior art devices provide some arm protection. For example, U.S. Pat. No. 5,628,062 (Tseng) discloses an arm and hand protective sleeve that helps prevent automotive drivers from contracting skin damage or skin diseases from ultraviolet solar radiation while driving. U.S. Pat. No. 5,642,525 (Ketola) discloses a bandage for protecting an elbow without providing any sliding contact between the bandage and the elbow. U.S. Pat. No. 6,464,669 (Wilke) discloses a protective sheeth that may be slid over a patient's arm or leg for holding a peripherally inserted central catheter in place.

These prior art devices have a number of disadvantages. None of the devices appears to provide substantial protection against fire, punctures, or infectious agents. The device disclosed by Ketola does not extend fully from the upper arm to the lower arm. All of these devices must be removed from the arm for storage. None of these devices is designed to securely fasten to the clothes of the wearer, which may make their use inconvenient and reduce the speed with which they can be deployed. There is accordingly a need for an arm protection device which overcomes the disadvantages of the prior art.

SUMMARY OF THE INVENTION

The present invention is directed to a device for protecting the arm of a user wearing a shirt. The device comprises a sleeve made of a protective fabric and a tubular fabric pouch. The sleeve can be extended from a retracted position to an extended position. The sleeve is shaped and sized to envelop a user's lower arm when the sleeve is in its extended position. The lower end of the sleeve has a hand opening sized to allow the user's hand to extend therethrough.

The pouch is sized to extend around the user's upper arm, and shaped to provide a circumferentially extending storage cavity for storing the protective sleeve. The pouch includes closure means for releasably closing the storage cavity when the sleeve is stored inside in the retracted position, and attachment means for attaching the pouch to an upper arm portion of the user's shirt. The upper end of the sleeve is affixed to an inner portion of the pouch.

The tubular fabric pouch may consist of an inner sleeve portion and an outer sleeve portion. The outer sleeve portion may be folded over the inner sleeve portion to form a folded position, which defines the storage cavity. The outer sleeve portion may be attached to the inner sleeve portion along a circumferential line of attachment. The inner sleeve portion and outer sleeve portion of the pouch have inside surfaces facing each other in the folded position. The outer sleeve portion may be folded inside out to form an unfolded position exposing the inside surfaces of the outer sleeve portion and the inner sleeve portion to facilitate replacing the sleeve in the retracted position after deployment.

The cavity closure means may comprise a plurality of circumferentially spaced pairs of snaps located adjacent the lower circumferential edges of the sleeve portions of the pouch. The lower end of the protective sleeve may comprise a cuff having adjusting means for adjusting the size of the hand opening.

The sleeve may comprise a fastening means to adjustably and securely fasten the lower end of the sleeve around the user's wrist. The sleeve may have a tapered lower end to better fit the lower arm. The sleeve may be provided with a slit in the lower arm portion with a slit closure means for releasably closing the slit.

BRIEF DESCRIPTION OF THE DRAWINGS

The invention will now be described, by way of example only, with reference to the following drawings, in which.

DETAILED DESCRIPTION OF THE INVENTION

Figure 1:
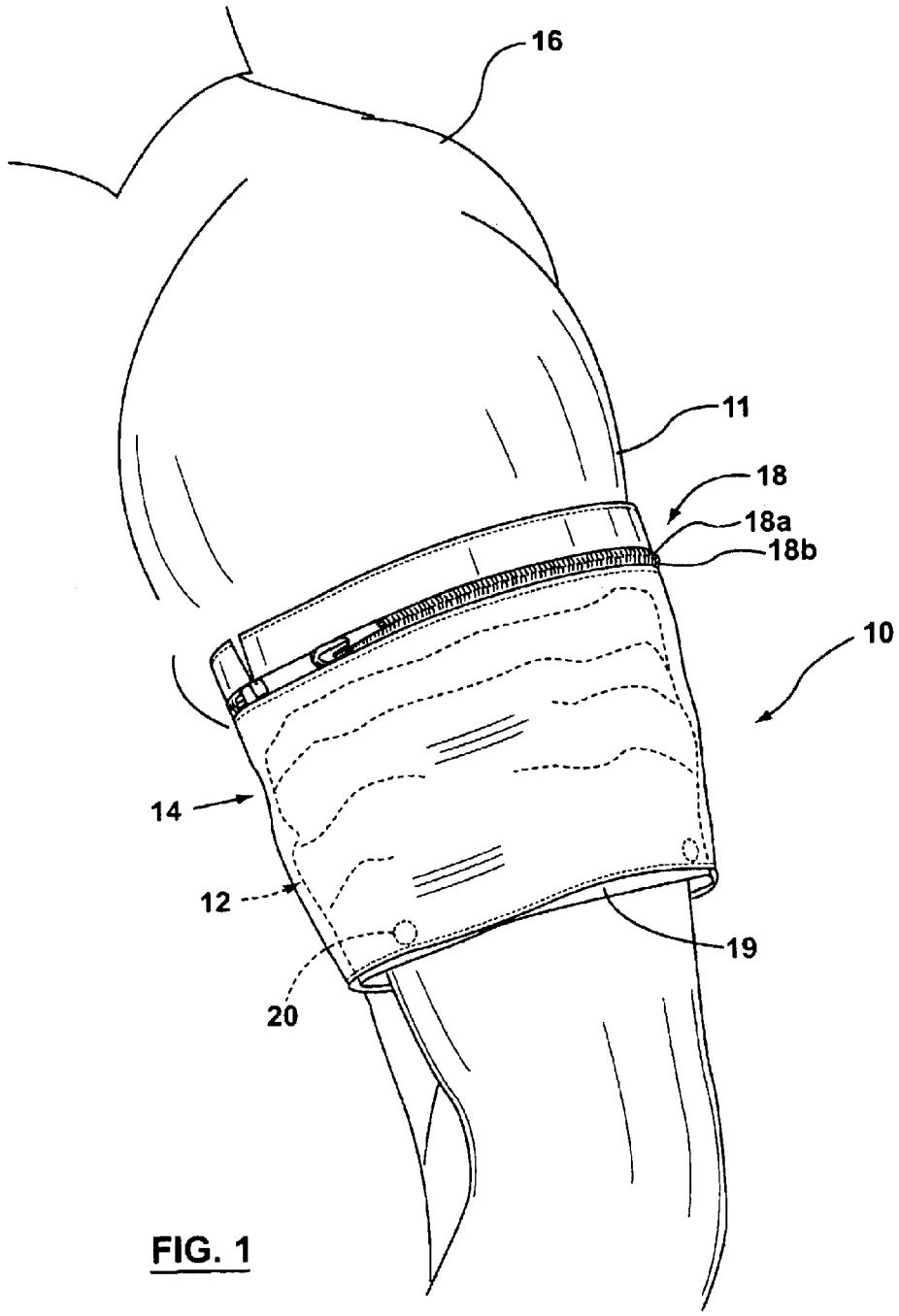
FIG. 1 is a perspective view of a preferred embodiment of an arm protection device made in accordance with the present invention, shown attached to a user's garment.

Referring to FIG. 1, illustrated therein is a preferred embodiment of an arm protection device 10 made in accordance with the subject invention, shown deployed on a user's short sleeve shirt 16. Arm protection device 10 comprises a tubular fabric pouch 14 and a protective sleeve 12, shown in dotted lines, stored within pouch 14. Tubular pouch 14 is sized to extend around upper arm portion 11 of shirt 16, and shaped to form a circumferentially extending storage cavity 19 for storing protective sleeve 12 in a retracted position. Tubular pouch 14 includes closure means 20, comprising snaps in this embodiment, for closing storage cavity 19. Tubular pouch 14 includes shirt attachment means 18 for securely and releasably attaching pouch 14 to upper arm portion 11. Shirt attachment means 18 is preferably a zipper comprising an upper row of zipper teeth 18*a* sewn to upper arm portion 11, a lower row of zipper teeth 18*b* sewn to the top of pouch 14, and zipper slide 18C which engages teeth 18*a*, 18*b* to open and close the zipper.

Figure 2:
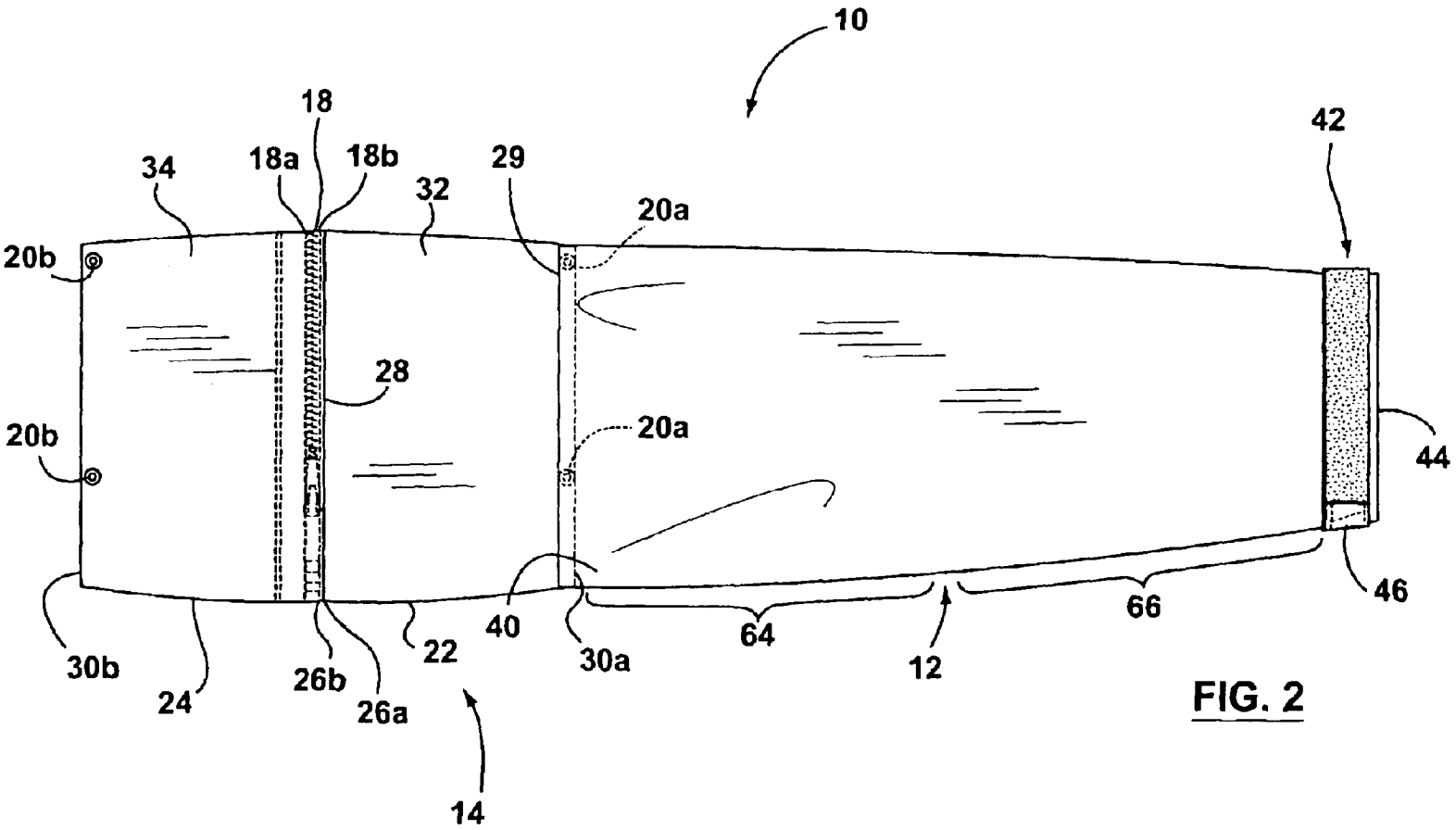
FIG. 2 is a top plan view of the subject arm protection device, showing the protective sleeve in the fully extended position and the outer sleeve portion of the tubular pouch folded inside out.

Referring now to FIG. 2, illustrated therein is arm protection device 10 with tubular pouch 14 folded inside out and protective sleeve 12 in a fully extended position. Tubular pouch 14 comprises an inner sleeve portion 22 and an outer sleeve portion 24. Inner sleeve portion 22 and outer sleeve portion 24 have upper circumferential edges 26*a*, 26*b* and lower circumferential edges 30*a*, 30*b*, respectively. Upper circumferential edges 26*a*, 26*b* are attached, preferably sewn, to each other along a circumferential line of attachment 28. Thus, when the outer sleeve portion 24 is folded over inner sleeve portion 22, sleeve portions 22, 24 form the walls of storage cavity 19 (shown in FIG. 1) in which protective sleeve 12 is stored in the retracted position when not in use. Lower circumferential edges 30*a*, 30*b* of inner sleeve portion 22 and outer sleeve portion 24 are not attached to each other and create an opening from which the sleeve 12 may be withdrawn for deployment.

Inner sleeve portion 22 of pouch 14 comprises an inside surface 32, and outer sleeve portion 24 of pouch 14 comprises an inside surface 34. Upper end 40 of protective sleeve 12 is attached to inside surface 32 of inner sleeve portion 22 along a circumferentially extending line of attachment 29 spaced from lower circumferential edge 30*a* of inner sleeve portion 22. Male snap portions 20*a* of closure means 20 are located between circumferential line of attachment 29 and lower circumferential edge 30*a* of inner sleeve portion 22, and female snap portions 20*b* of closure means 20 are located along lower circumferential edge 30*b* of outer sleeve portion 24. When outer sleeve portion 24 is folded over inner sleeve portion 22, snap portions 20*a*, 20*b* may be fastened together to releasably close pouch 14.

As further illustrated in FIG. 2, protective sleeve 12 comprises an upper main portion 64 of substantially constant diameter and a lower tapered portion 66 having a progressively decreasing diameter to better fit the user's lower arm. Tapered lower portion 66 comprises a cuff portion 42 having a hand opening 44 sized to allow a user's hand to extend through, and adjusting means 46 for adjusting the size of the hand opening to fit a user's wrist.

Figure 3:
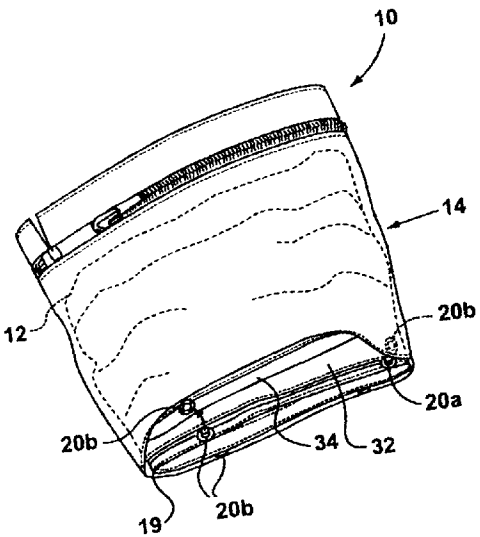
FIG. 3 is a perspective view of the subject arm protection device, showing the protective sleeve in the retracted position inside the tubular pouch.

Referring now to FIG. 3, tubular pouch 14 is shown in its folded over position, with protective sleeve 12 stored in its retracted position in cavity 19. Snaps 20*a*, 20*b* are shown unsnapped, exposing inside surfaces 32, 34, and allowing protective sleeve 12 to be removed from pouch 14.

Figure 4:
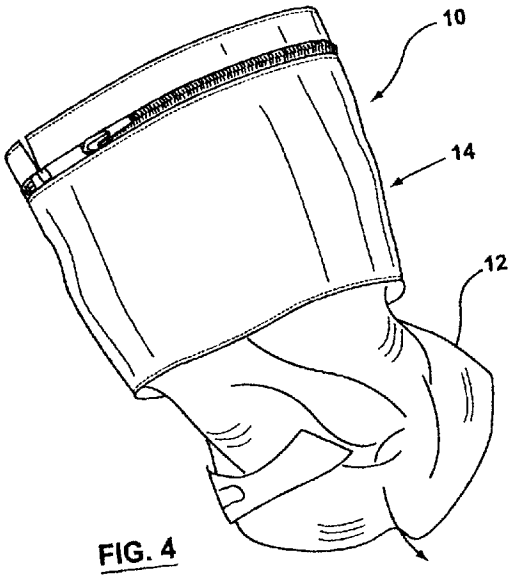
FIG. 4 is a perspective view of the arm protection device of the present invention, showing the protective sleeve in the process of being extended from the tubular pouch.

Referring now to FIG. 4, arm protection device 10 is shown with protective sleeve 12 in the process of being removed from tubular pouch 14. The user may extend sleeve 12 by pulling sleeve 12 downward in the direction of the arrow.

Figure 5:
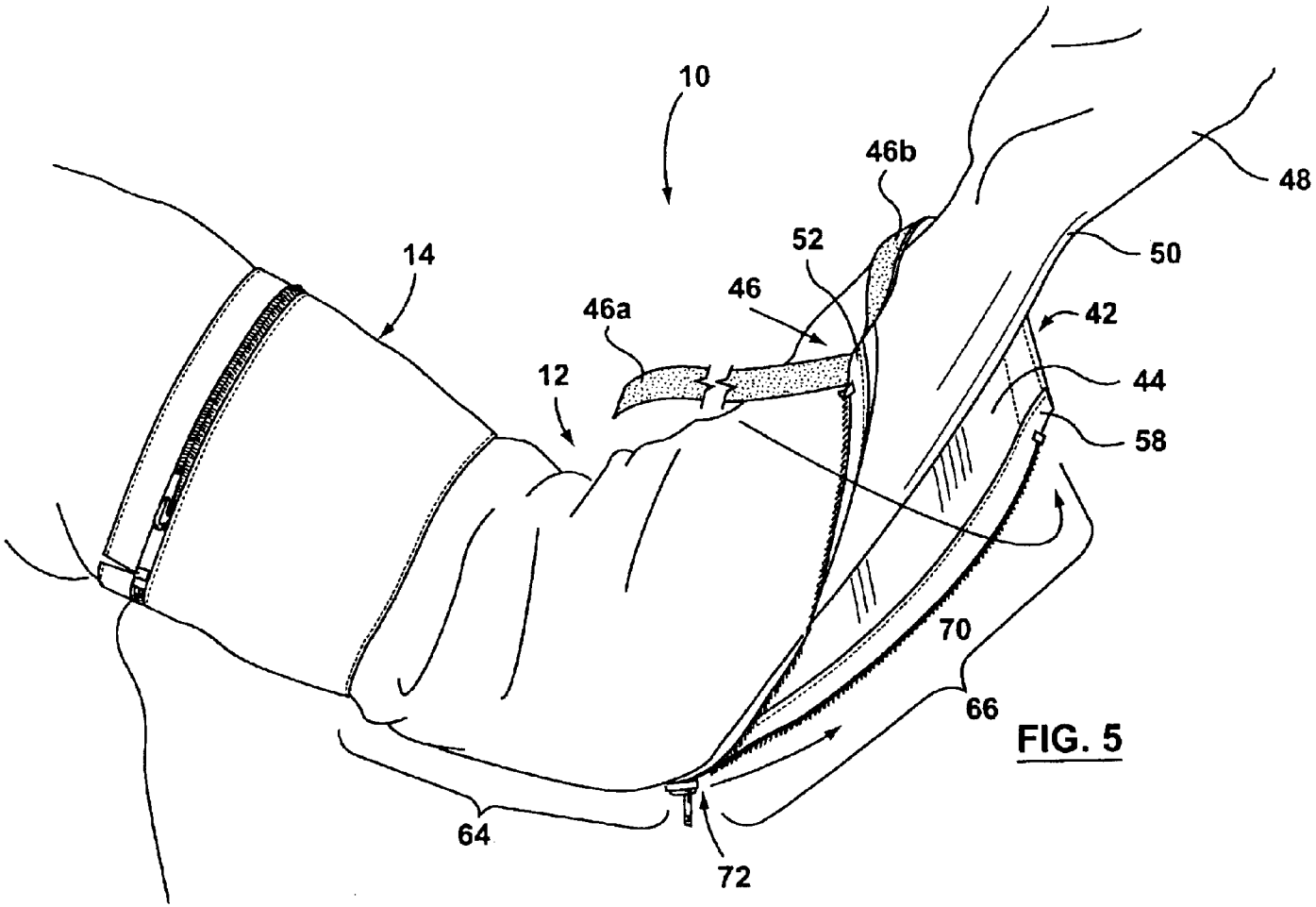
FIG. 5 is a perspective view of the subject arm protection device, shown deployed on a user's arm, with the protective sleeve in the extended position, before the sleeve is fastened around the user's wrist.

Referring now to FIG. 5, arm protection device 10 is shown deployed on a user's arm, with the protective sleeve 12 in the extended position. Protective sleeve 12 has been pulled downward, thus exposing main portion 64 of sleeve 12 and the tapered portion 66 of sleeve 12. Tapered portion 66 is provided with a longitudinally extending slit 70 which splits cuff portion 42 in two, and slit closure means 72, comprising a zipper in the preferred embodiment, for releasably closing slit 70. Adjusting means 46 of cuff portion 42 allows the user to adjust the size of hand opening 44 to securely fit cuff portion 42 around user's wrist 50 once the user's hand 48 has been extended through sleeve 12. Adjusting means 46 is preferably a VELCRO (trade mark) hook and loop fastener, comprising a first strip 46*a* extending from cuff corner 52 and a second strip 46*b* extending around the circumference of cuff portion 42. Velcro strip 46*b* has loops shaped to be releasably secured to hooks of Velcro strip 46*a*.

Figure 6:
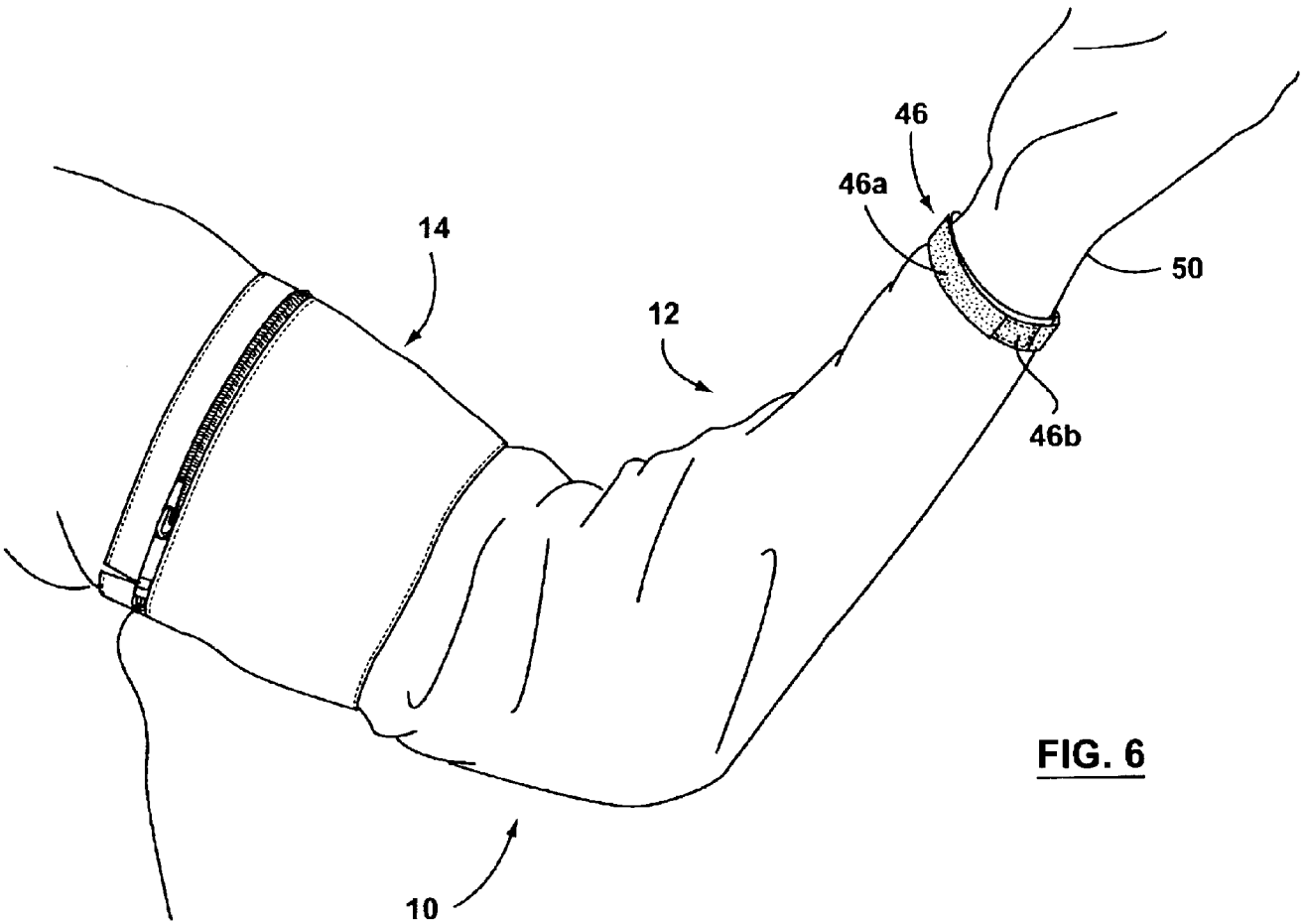
FIG. 6 is a perspective view of the subject arm protection device, shown in a fully deployed position, with the protective sleeve fastened around the user's wrist.

Referring now to FIG. 6, arm protection device 10 is shown fully deployed with protective sleeve 12 in the fully extended position. Adjusting means 46 is shown closed around user's wrist 50, with first Velcro strip 46*a* removably secured to second Velcro strip 46*b*.

In the preferred embodiment, the pouch and sleeve are constructed from a pre-selected protective material, comprising, in the preferred embodiment, Nitrile coated nylon with Kevlar netting. The netting may be structured similarly to the netting found in duct tape.

The present invention is deployed in the following manner. As shown in FIG. 1, tubular pouch 14 of arm protection device 10 is attached to upper arm 11 of the user's short-sleeve shirt 16 by attachment means 18. Protective sleeve 12 is stored in the retracted position within the tubular pouch 14 and is maintained in that position by closure means 20. When the user wishes to deploy sleeve 12, the user unfastens snaps 20*a*, 20*b* and removes sleeve 12 by pulling it downward as shown in FIG. 4. As illustrated in FIG. 5, once the sleeve is extended, the user closes slit 70 by operating closure means 72. As further shown in FIGS. 2, 5, and 6, the user then securely fastens cuff portion 42 around wrist 50 by adjustably fastening Velcro strips 46*a*, 46*b*.

To replace protective sleeve 12 in the retracted position in tubular pouch 14 after use, the user first unfastens Velcro strips 46*a*, 46*b*. The user then unzips closure means 72 to open slit 70. Protective sleeve 12 may then be bunched up and inserted into cavity 19 of tubular pouch 14. This action exposes male snaps 20*a* on inner sleeve portion 22, which may then be attached to the female snaps 20*b* on outer sleeve portion 24, thus closing tubular pouch 14.

Referring again to FIG. 2, to facilitate replacing protective sleeve 12 in the retracted position, the user may optionally fold outer sleeve portion 24 of tubular pouch 14 upwards and inside out as shown in FIG. 2, before protective sleeve 12 is placed in pouch 14. This allows the user to bunch up protective sleeve 12 into the retracted position without being encumbered by the outer sleeve portion 24 of pouch 14. After protective sleeve 12 has been placed in the retracted position, the user folds outer sleeve portion 24 of tubular pouch 14 downwards and closes cavity 19 by fastening snaps 20*a* of inside sleeve portion 22 to snaps 20*b* of outside sleeve portion 24.

While the preferred embodiment of the tubular pouch consists of two sleeve portions sewn together, the tubular pouch could comprise a single sleeve having a fold line, which could be folded over to form the storage cavity for the protective sleeve. While the preferred means for attaching the pouch to a user's shirt is a zipper, the pouch could be permanently attached to the shirt, or the pouch could be releasably attached by alternative fasteners, such as Velcro strips or snaps. Similarly, the snaps and Velcro strips and other zipper of the preferred embodiment could be interchanged or replaced by alternative fastening means. In addition, the pouch and protective sleeve could be constructed of alternative protective means, including reflective materials which would allow the user to be more visible for activities such as directing traffic.

It should therefore be apparent to one skilled in the art that various modifications can be made to the preferred embodiment disclosed herein, without departure from the invention, the scope of which is defined in the appended claims.

What is claimed is:

1. A device for protecting the arm of a user wearing a shirt, comprising:

a) a protective sleeve made of a pre-selected protective fabric, the sleeve being extendible between a retracted position and an extended position, the sleeve being shaped and sized to envelop a user's lower arm when the sleeve is in the extended position, the protective sleeve having an upper end and a lower end, the lower end having a hand opening sized to allow the users hand to extend therethrough; and b) a tubular fabric pouch sized to extend around the user's upper arm, the pouch being shaped to provide a circumferentially extending storage cavity for storing the protective sleeve when the protective sleeve is in the retracted position, the pouch having cavity closure means for releasably closing the storage cavity when the protective sleeve is stored inside, and shirt attachment means for attaching the pouch to an upper arm portion of the user's shirt, wherein the upper end of the protective sleeve is affixed to an inner portion of the pouch.

2. The device of claim 1, wherein the tubular pouch comprises a pouch sleeve having an inner sleeve portion and an outer sleeve portion, wherein the outer sleeve portion may be folded over the inner sleeve portion to form a folded position defining the storage cavity for storing the protective sleeve.

3. The device defined in claim 2, wherein the inner sleeve portion and the outer sleeve portion, are attached to each other along a circumferential line of attachment.

4. The device defined in claim 2, the inner sleeve portion and outer sleeve portion have inside surfaces facing each other when the pouch is in the folded position, and wherein the outer sleeve portion may be folded inside out to form an unfolded position exposing the inside surfaces of the outer sleeve portion and the inner sleeve portion to facilitate replacing the protective sleeve in the retracted position after deployment.

5. The device defined in claim 3, wherein the outer sleeve portion and the inner sleeve portion of the pouch have lower circumferential edges and upper circumferential edges, wherein the upper circumferential edges are sewn together along a circumferential line of attachment, and the lower circumferential edges define an opening through which the sleeve may be extended.

6. The device defined in claim 5, wherein the upper end of the protective sleeve is attached to the inner sleeve portion of the pouch along a circumferentially extending line of attachment spaced from the lower circumferential edge thereof.

7. The device defined in claim 5, wherein the cavity closure means comprises a plurality of circumferentially spaced pairs of snaps located adjacent the lower circumferential edges of the sleeve portions of the pouch.

8. The device defined in claim 1, wherein the lower end of the protective sleeve comprises a cuff portion having adjusting means for adjusting the size of the hand opening for securely fitting the lower end of the protective sleeve around the user's wrist.

9. The device defined in claim 1, wherein the protective sleeve comprises a main portion of substantially constant diameter and a lower tapered portion having a progressively decreasing diameter.

10. The device defined in claim 9, wherein the lower tapered portion of the protective sleeve is provided with a longitudinally extending slit and slit closure means for releasably closing the slit.

11. The device defined in claim 1, wherein the shirt attachment means comprises a zipper comprising an upper row of zipper teeth affixed to the upper arm portion of the user's shirt, a lower row of zipper teeth affixed to the pouch, and a slide for engaging the lower zipper teeth and the upper row of zipper teeth.

12. The device defined in claim 8, wherein the cuff portion is split and the adjusting means comprises a first hook and loop strip extending from one corner of the cuff portion and a second hook and loop strip extending around the cuff, the first hook and loop strip being removably adjustably fastenable to the second hook and loop strip to adjust the size of the hand opening around the wrist.

13. The device defined in claim 1, wherein the preselected protective fabric is a Nitrile coated Nylon fabric.

14. The device defined in claim 13, wherein the fabric comprises Kevlar netting.

15. The device defined in claim 10, wherein the slit closure means comprises a zipper.

16. The device defined in claim 7, wherein the pairs of snaps comprise male snaps on the inner sleeve portion and female snaps on the outer sleeve portion.

* * * * *